US006148163A

United States Patent [19]

Ito

[11] Patent Number: 6,148,163

[45] Date of Patent: Nov. 14, 2000

[54] CONTROL SPEED AND FUSER TEMPERATURE BASED UPON MONOCHROMATIC OR FULL-COLOR PRINTING

[75] Inventor: Katsuyuki Ito, Tokyo, Japan

[73] Assignee: Oki Data Corporation, Tokyo, Japan

[21] Appl. No.: 09/241,131

[22] Filed: Feb. 1, 1999

[30] Foreign Application Priority Data

Feb. 10, 1998 [JP] Japan ..... 10-028734

[51] Int. Cl.[7] ..... G03G 15/20

[52] U.S. Cl. ..... 399/67; 399/69; 399/82; 399/299; 399/303; 399/396

[58] Field of Search ..... 399/298, 299, 399/303, 306, 67, 69, 388, 396, 397, 400; 430/124, 126; 219/216

[56] References Cited

U.S. PATENT DOCUMENTS

| | | | |
|---|---|---|---|
| 4,549,803 | 10/1985 | Ohno et al. | 399/45 |
| 5,001,519 | 3/1991 | Saito | 399/69 |
| 5,408,301 | 4/1995 | Tokishige et al. | 399/69 |
| 5,517,293 | 5/1996 | Tonai et al. | 399/331 |
| 5,587,783 | 12/1996 | Nakamura et al. | 399/301 |
| 5,659,864 | 8/1997 | Oka et al. | 399/67 X |
| 5,724,628 | 3/1998 | Sano | 399/69 X |

FOREIGN PATENT DOCUMENTS 7-219385 8/1995 Japan .

*Primary Examiner*—William J. Royer
*Attorney, Agent, or Firm*—Akin, Gump, Strauss, Hauer & Feld, L.L.P.

[57] ABSTRACT

A color image forming apparatus is capable of color printing and monochrome printing in accordance with print data. The apparatus has a plurality of image-forming sections that print toner images of corresponding different colors. The plurality of image-forming sections are aligned in a direction of travel of a recording medium, and print the respective toner images on the recording medium in superposition. The toner images are subsequently fixed at a fixing unit. The apparatus includes a data-identifying section and a mode-selecting section. The data-identifying section identifies the print data as to whether the print data is for color printing or for monochrome printing. The mode-selecting section selects a multi-color mode if the print data is for color printing and a mono-color mode if the print data is for mono-color printing. A printing operation is performed at a higher speed in the mono-color mode than in the multi-color mode. The mode-selecting section sets the fixing unit for a higher fixing temperature in the mono-color mode than in the multi-color mode.

8 Claims, 3 Drawing Sheets

| CURVE | Tm (℃) | V (mm/s) |
|---|---|---|
| A | 90 | 50 |
| B | 120 | 50 |
| C | 90 | 100 |
| D | 120 | 100 |

← COLOR MOOE ( FIX. TEMP = 150℃ )

← MONOCHROME MOOE ( FIX. TEMP = 180℃ )

CONTROL SPEED AND FUSER TEMPERATURE BASED UPON MONOCHROMATIC OR FULL-COLOR PRINTING

BACKGROUND OF THE INVENTION

The present invention relates to a color image recording apparatus where a plurality of image-forming sections transfer toner images of corresponding colors to a recording medium in sequence.

Conventionally, a tandem-type color image-recording apparatus has been proposed where a monochrome printing and a color printing are selectively performed. The color printing is performed by superposing yellow, magenta, cyan, and black images. The apparatus incorporates a color data separator which separates if the received print data is for color printing, then the color data separator separates the print data into color data of the respective colors. Each of the color data is fed to a corresponding one of image-forming sections aligned in a direction of travel of the print medium. The toner images of the respective colors are transferred on the print medium one over the other in sequence as the recording medium travels through the image-forming sections. The transferred toner images are then fused in a fixing unit into a full color image. The color printing requires longer time than the monochrome printing.

SUMMARY OF THE INVENTION

With the conventional color printer, the color printing and the monochrome printing are performed at the same speed. In other words, the speed in the monochrome printing is lower than it could have been. Thus, the controller is not operated to its full capacity during the monochrome printing.

An object of the present invention is to provide a color image recording apparatus where the monochrome printing and color printing are performed at different speeds so that the controller operates to its full capacity.

An object of the invention is to provide a color image recording apparatus where the monochrome printing is effected faster than the color printing.

A color image forming apparatus is capable of color printing and monochrome printing in accordance with print data. The apparatus has a plurality of image-forming sections that print toner images of corresponding different colors (Y,M,C,B) The plurality of image-forming sections are aligned in a direction of travel of a recording medium, and print the respective toner images on the recording medium in superposition. The toner images are subsequently fixed at a fixing unit. The apparatus includes a data-identifying section (i.e., interface) and a mode-selecting section (mode selector). The data-identifying section identifies the print data as to whether the print data is for color printing or for monochrome printing. The mode-selecting section selects a multi-color mode if the print data is for color printing and a mono-color mode if the print data is for mono-color printing. A printing operation is performed at a higher speed in the mono-color mode than in the multi-color mode.

The mode-selecting section sets the fixing unit for a higher fixing temperature in the mono-color mode than in the multi-color mode.

A first type of toner is used in the mono-color mode and a second type of toner is used in the multi-color mode, the first type of toner having a lower melting point than the second type of toner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the invention will be described in detail with reference to the accompanying drawings.

Figure 1:
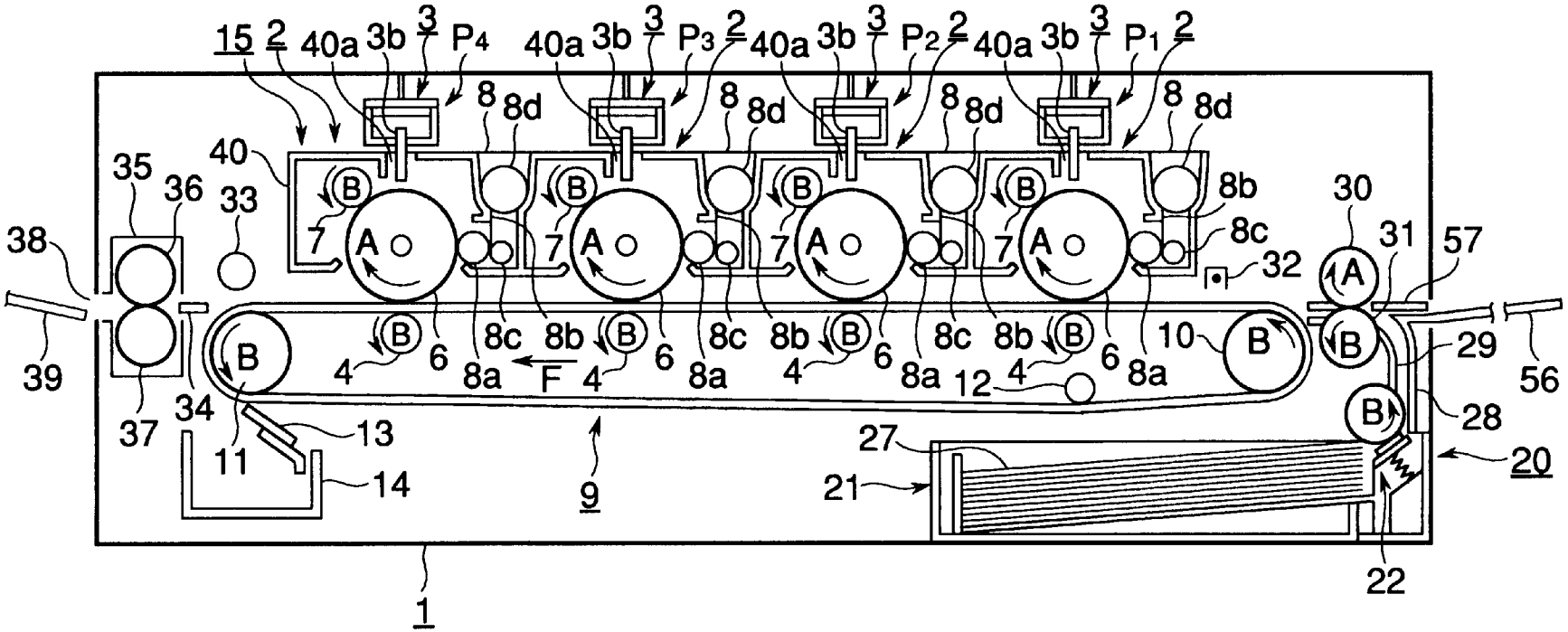
FIG. 1 illustrates a general construction of a color image recording apparatus of an embodiment of the invention.

FIG. 1 illustrates a general construction of a color image recording apparatus of an embodiment of the invention. The color image recording apparatus of the embodiment is an electrophotographic printer for use with a computer.

A color image recording apparatus 1 incorporates print engines P1, P2, P3, and P4 aligned from a medium-feeding side to a medium-discharging side, in the direction of travel of the recording medium 27 as shown by arrow F. The print engines P1–P4 are of the same structure having an LED printhead. The print engines print yellow, magenta, cyan, and black toner images on the recording medium 27, respectively. By way of example, only the print engine P1 will be described.

The print engine P1 includes an image-forming section 2 having a photoconductive body 6, and transfer roller 4 that transfers the toner image formed on the photoconductive body 6 to the recording medium 27. The image-forming section 2 includes a charging roller 7, an LED head 3, and a developing unit 8. The charging roller 7 uniformly charges the surface of the photoconductive body 6. The LED head 3 illuminates the charged surface of the photoconductive body 6 to form an electrostatic latent image thereon. The developing unit 8 develops the electrostatic latent image with yellow toner.

The developing unit includes a developing roller 8*a*, a developing blade 8*b*, a sponge roller 8*c*, and a toner tank 8*d*. The toner tank 8*d* holds non-magnetic, single composition toner therein. The toner is supplied to the developing blade 8*b* through the sponge roller 8*c* and a thin layer of toner is applied on the circumferential surface of the developing roller 8*a*. The sponge roller serves to apply a proper amount of toner to the blade 8*b*. When the toner is formed into a thin layer, the toner particles are rubbed between the developing roller 8*a* and the developing blade 8*b* so that the toner particles are triboelectrically charged. In the embodiment, the toner is negatively triboelectrically charged. Then, the toner layer on the developing roller 8*a* is brought into contact with photoconductive body 6. When the toner in the developing unit 8 is exhausted, the toner tank 8*d* is replaced.

The LED head 3 includes LED arrays, not shown, a printed circuit board, not shown, on which the LED arrays and LED array driver ICs are mounted, and a selfoc lens array 3*b* that gathers the light emitted from the LED arrays. The driver ICs drive corresponding LED arrays so that the LED arrays emit light in accordance with image data inputted through a later described interface. The light illuminates the uniformly charged surface of the photoconductive body 6 to form an electrostatic latent image.

A transport belt 9 runs between the transfer rollers 4 and the photoconductive bodies 6 of the respective print engines P1–P4. The transport belt 9 is an endless belt formed of a high resistance semiconductive plastic film. The transport belt 9 is mounted about a driven roller 10, a drive roller 11 coupled to a later described motor, and a tension roller 12. The transport belt 9 is charged by a charging device 32 and attracts the recording medium 27 by Coulomb force, and transports the recording medium 27 placed thereon.

There is provided a cleaning blade 13 so that the transport belt 9 runs through a gap between the drive roller 11 and the cleaning blade 13. The cleaning blade has a tip that engages the transport belt 9 to scratch the surface of the transport belt 9 as the transport belt 9 runs. Thus, the cleaning blade 13 scratches off the residual toner left on the transport belt 9 into a waste toner tank 14.

Disposed under the print medium-feeding area is a paper-feeding mechanism 20. The paper-feeding mechanism 20 includes a cassette 21 that accommodates a stack of recording medium 27 therein, an medium-advancing mechanism 22, and registry rollers 30 and 31. A manual insertion tray 56 extends outwardly from the registry rollers 30 and 31, so that the user can feed the recording paper 27 along the manual insertion tray 56 and guide 57.

A neutralizer 33 is disposed over the transport belt 9 and above the drive roller 11. The neutralizer 33 neutralizes the static electricity on the transport belt 9 and the recording medium 27 on the transport belt 9, facilitating the recording medium 27 to leave the transport belt 9 after transfer operation.

A guide 34 and fixing unit 35 are disposed downstream of the neutralizer 33 with respect to a direction shown by arrow F in which the recording medium 27 travels. The fixing unit 35 fuses the toner images transferred from the photoconductive bodies 6 to the recording medium 27 by the transfer rollers 4 at the respective print engines. The fixing unit 35 includes a heat roller 36 that heats the toner on the recording medium 27, and a pressure roller 37 that presses the recording medium 27 against the heat roller 36. The recording medium 27 leaving the fixing unit 35 is discharged through a discharge exit 38 to a stacker 39.

The control block of the embodiment will now be described with reference to FIG. 2.

Figure 2:
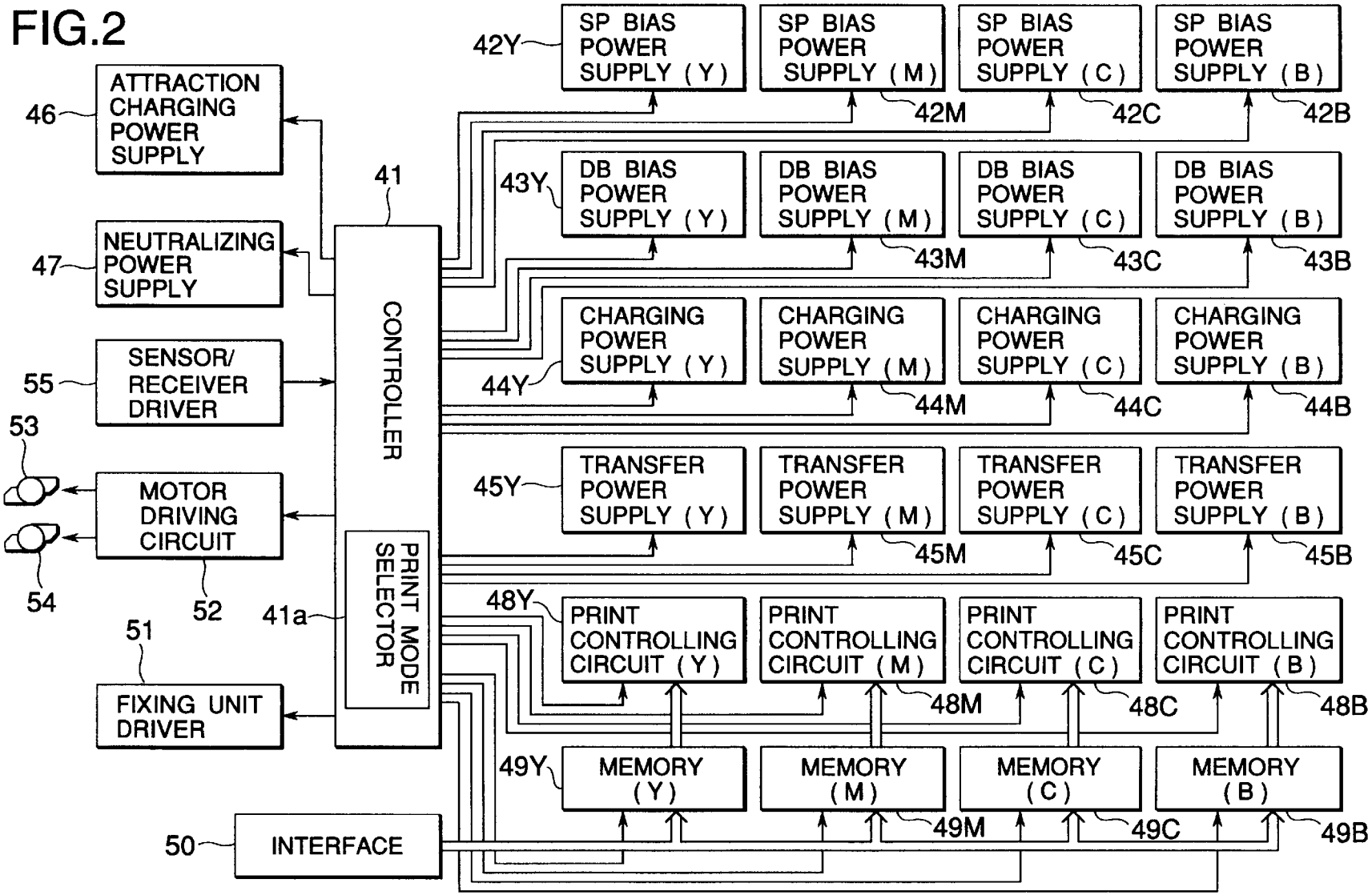
FIG. 2 is a block diagram illustrating the control system of the embodiment.

FIG. 2 is a block diagram illustrating the control system of the embodiment. Characters Y, M, C, and B represent print engines P1 (yellow), P2 (magenta), P3 (cyan), and P4 (black).

A controller 41 takes the form of, for example, a microprocessor and controls the overall operation of the electrophotographic recording apparatus 1. The controller 41 is connected to SP bias power supplies 42Y, 42M, 42C, and 42B, DB bias power supplies 43Y, 43M, 43C, and 43B, charging power supplies 44Y, 44M, 44C, and 44B, and transfer power supplies 45Y, 45M, 45C, and 45B. The SP bias power supplies apply negative voltages to the sponge rollers 8*c* of the developing units 8. The DB bias power supplies apply negative high voltages to the developing rollers 8*a*. The charging power supplies apply negative high voltages to the charging rollers 7. The transfer power supplies apply positive high voltages to the transfer rollers 4.

The controller 41 is also connected to an attraction charging supply 46 that applies a positive high voltage to the charging device 32 and to a neutralizing power supply 47 that applies a voltage to a neutralizer 33 for the neutralization of the transport belt 9.

The respective power supplies are controllably driven under instructions from the controller 41.

The controller 41 connected to print controlling circuits 48Y, 48M, 48C, and 48B that correspond to the print engines P1–P4. The print controlling circuits 48Y, 48M, 48C, and 48B receive the image data from memories 49Y, 49M, 49C, and 49B under the control of the controller 41 and direct the image data to the corresponding LED heads 3. The print controlling circuits controls the time for which the LED heads 3 illuminate the surfaces of the corresponding photoconductive bodies 6 to form electrostatic latent images thereon.

The memories 49Y, 49M, 49C, and 49B receive image data from an external apparatus, for example, host computer, through the interface 50, and store the image data. The interface 50 separates the image data received from the external apparatus into individual color data. Yellow image data is stored into the memory 49Y, magenta image data into the memory 49M, cyan image data into the memory 49C, and black image data into the memory 49B, respectively.

The controller 41 is also connected to a fixing unit driver 51, motor driving circuit 52, and sensor/receiver driver 55. The fixing unit drive 51 drives a heater, not shown, in the heat roller 36 so as to maintain the heat roller 36 at a constant temperature. The motor driving circuit 52 drives motors 53 and 54 that drive the medium-feeding mechanism 22.

The motor 54 drives in rotation the registry rollers 30 and 31, photoconductive body 6, charging roller 7, developing roller 3*a*, sponge roller 8*c*, transfer roller 4, drive roller 10, and heat roller 36 of each of the print engines P1–P4. A gear train or belts, not shown link the rollers driven by the motor 54. The sensor/receiver driver 55 drives a photo-interrupter, not shown, that detects the presence and absence of the recording medium 27. The sensor/receiver driver 55 sends the output waveform of the photo-interrupter to the controller 41.

The controller 41 has a print mode selector 41*a* so as to switch the print mode between a multi-color mode and a mono-color mode. The controller 41 automatically sets the print mode to the multi-color mode when the printer is first set up after power-on.

In the multi-color mode, a plurality of print engines are simultaneously driven for superposing toner images of the respective colors and the fusing of toner takes a long time. In the mono-color mode, only one print engine is driven. Thus, the mono-color printing is faster than the multi-color printing. When the interface 50 receives print data from an external apparatus, the interface 50 informs the print mode selector 41*a* as to whether the received print data is multi-color print data or mono-color print data, and switches the print mode appropriately according to the nature of the print data.

The printing operation of the color image recording apparatus according to the present invention will now be described.

Upon power up of the color image recording apparatus 1, the controller 41 carries out initialization. Then, the controller 41 drives the fixing unit driver 51 to heat the heat roller 36 in the fixing unit 35 to a predetermined temperature, and subsequently controls the heat roller 36 so as to maintain the heat roller at a constant temperature. When the heat roller reaches the predetermined temperature, the controller 41 drives the motor drive circuit 52, thereby rotating the drive roller 11 in a direction shown by arrow B so that the transport belt 9 runs. The motor 54 is stopped so that the transport belt 9 stops after it has run a distance little longer than one complete rotation thereof. Such a rotation of the transport belt 9 allows the cleaning blade 13 to clean residual toner and dust on the transport belt 9. The residual toner and dust are collected into the waste toner tank 14.

The printing mode is set to the multi-color mode. This completes the initialization of the color image recording apparatus 1. The controller 41 waits for image data sent from the external apparatus through the interface 50.

When the controller 41 receives the image data for color printing, the controller 41 outputs instructions to the interface 50 and memories 49Y, 49M, 49C, and 49B. Upon the instruction from the controller 41, the interface 50 separates the received image data into the yellow, magenta, cyan, and black data and stores the color data into the corresponding memories 49Y, 49M, 49C, and 49B.

The memories 49Y, 49M, 49C, and 49B store color data which is to be printed on one page of the recording medium 27.

The controller 41 drives the motor driving circuit 52, thereby driving the motor 53 in rotation, the motor 53 driving the medium feeding mechanism 22 to feed one page of the recording medium 27 from the cassette 21.

The controller 41 causes the motor 54 to drive the photoconductive bodies 6, charging rollers 7, developing rollers 8*a*, sponge rollers 8*c*, transfer rollers 4, drive rollers 11, registry rollers 30 and 31 and heat roller 36, all of the print engines P1–P4. At the same time, the controller 41 turns on the attraction power supply 46 so as to apply a voltage to the charging device 32.

The recording medium 27 is thus advanced to the charging device 32 which charges the recording medium 27 so that the recording medium 27 is attracted by Coulomb force to the transport belt 9. When the controller 41 determines, based on the signal from the sensor/receiver driver 55, that the rearward end of the recording medium 27 has passed the medium feeding mechanism 22, the controller causes the motor 53 to stop.

In the mean time, the controller 41 turns on the charging power supplies 44Y, 44M, 44C, and 44B and SP bias power supplies 42Y, 42M, 42C, and 42B in order to apply negative voltages to the charging rollers, developing rollers 8*a*, and sponge rollers 8*c*, all of the print engines P1–P4. Thus, the surface of the respective photoconductive body 6 is uniformly negatively charged by means of the charging roller 7, and the sponge roller 8*c* and developing roller 8*a* receive predetermined negative high voltages.

The controller 41 then outputs an instruction to the memory 49Y in which yellow image data is stored, causing the memory 49Y to send yellow image data for one line to the print controlling circuit 48Y. In response to the instruction from the controller 41, the print controlling circuit 48 transfers the yellow image data received from the memory 49Y to the LED head 3 of the print engine P1.

The LED head 3 causes the LEDs to emit light in accordance with the yellow image data, thereby illuminating the surface of the photoconductive body 6. As a result, an electrostatic latent image is formed on the uniformly negatively charged surface of the photoconductive body 6 in accordance with the yellow image data. In this manner, the yellow image data received on a line-by-line basis from the memory 49Y is converted into an electrostatic latent image on the surface of the photoconductive body 6.

When the developing blade 8*b* applies a thin layer of toner to the developing roller 8*a* to which a negative high voltage has been applied, the toner is negatively charged. The negatively charged toner clings to the electrostatic latent image formed on the surface of the photoconductive body 6 by the Coulomb force. Thus, the electrostatic latent image on the photoconductive body is developed with yellow toner into a yellow toner image as the photoconductive body 6 rotates.

When the forward end of the recording medium 27 reaches between the photoconductive body 6 and the transfer roller 4, the controller 41 instructs the transfer power supply 45Y to apply a positive high voltage to the transfer roller 4. Thus, the negatively charged yellow toner image adhering to the photoconductive body 6 is attracted by the positively charged transfer roller 4, so that the yellow toner image for one page is transferred to the recording medium27 as the photoconductive body 6 rotates.

The image-forming section 2 according to the embodiment allows developing process and toner recovering process to be simultaneously performed. The toner is non-magnetic and one composition toner. The developing roller 8*a* has resiliency and electrical conductivity and is in light contact with the surface of the photoconductive body 6 with the thin layer of the toner therebetween. During the development of the electrostatic latent image, the developing roller 8*a* attracts, with the aid of the strong electric field, residual toner that has failed to be transferred to the last page of the recording medium 27, thereby recovering the residual toner. The recovered toner is returned to the toner-accommodating space, not shown, in the developing unit 8 for reuse.

The transport belt 9 continues to run so that the recording medium 27 travels from the print engine P1 to the print engine P2 where a magenta toner image is transferred in superposition to the yellow toner image. The detailed operation is the same as that of the print engine P1 and therefore the description thereof is omitted.

Likewise, the recording medium 27 travels from the print engine P2 though the print engine P3 to the print engine P4, so that cyan toner image and then black toner image are transferred one after the other to the recording medium 27.

It is to be noted that after the toner images have been transferred to the recording medium 27 at the print engines P2 and P3, the charging power supplies 44M and 44C, SP bias power supplies 42M and 42C, and DB bias power supplies 43M and 43C, and transfer power supplies 45M and 45C are turned off.

The recording medium 27 is subsequently transported on the transport belt 9 to the neutralizer 33. The controller 41 causes the neutralization power supply 47 to neutralize the recording medium 27 and the transport belt 9, so that the recording medium 27 smoothly leaves the transport belt 9 to the guide 34 which in turn guides the recording medium 27 to the fixing unit 35. After the recording medium 27 has left the neutralizer 33, the controller 41 turns off the neutralization power supply 47.

By the time the recording medium 27 arrives at the fixing unit 35, the heat roller 36 has reached a temperature such that the toner images on the recording medium 27 can be sufficiently fused. The recording medium 27 passes between the heat roller 36 and the pressure roller 37 and is subsequently discharged to the stacker 39. When a photo-interrupter, not shown, detects the rearward end of the recording medium 27, the controller 41 determines based on the output of he photo-interrupter that the recording medium 27 has been discharged to the stacker 39.

When the recording medium 27 has been discharged from the color image recording apparatus 1, the controller 41 causes the motor driving circuit 52 to stop the motor 54.

In the aforementioned manner, image data of multi-color pixels is printed on the recording medium 27.

The recording medium 27 may also be fed through the manual insertion tray 56 and color printing can be performed in the same manner. The operations of the print engines P1–P4 are the same as when the recording medium 27 is fed from the cassette 21.

<Mono-color mode and multi-color mode>

The mono-color mode and multi-color mode will now be described.

The printing operation is performed in two print modes. more than one colored toners are used in the multi-color mode and only one colored toner is used in the mono-color mode. The colored toner in the mono-color mode can be any one of the colored toners used in the multi-color mode. Therefore, the toner used in the mono-color mode can be, for example, any one of black, yellow, magenta, and cyan toners. For simplicity, the mono-color mode will be described with respect to a case where black toner is used.

Upon receiving the image data via the interface 50 from the external apparatus, the controller 41 outputs instructions to the interface 50 and the memory 49B. In response to the instruction, the interface 50 stores the received image data into the memory 49B. Only black image data is received from the external apparatus, and therefore no data is stored into the memories 49Y, 49M, and 49C. The interface 50 informs the controller 41 that the received image data is only for mono-color printing. Then, the controller 41 switches the print mode from the multi-color mode to the mono-color mode.

In this embodiment, the printing speed in the mono-color mode is twice that in the multi-color mode. In other words, the controller 41 controls the motor 52 in such a way that the speed of travel of the recording medium 27 (referred to as "transport speed" hereinafter), the rotational speed of the photoconductive body 6, etc., are twice those in the multi-color mode. The controller 41 also controls the print controlling circuit 48B in such a way that the speed of data transfer to the LED head 3 is two times higher in the mono-color mode than in the multi-color mode and the exposure time of the LED head 3 in the mono-color mode is half that in the multi-color mode.

The temperature of the heat roller 36 at which the fixing operation is performed is set about 30° C. higher in the mono-color mode than in the multi-color mode. The controller 41 controls the temperature of the heat roller 36 (referred to as "fixing temperature" hereinafter) appropriately depending on whether the print mode is the multi-color mode or the mono-color mode.

Figures 3A, 3B:
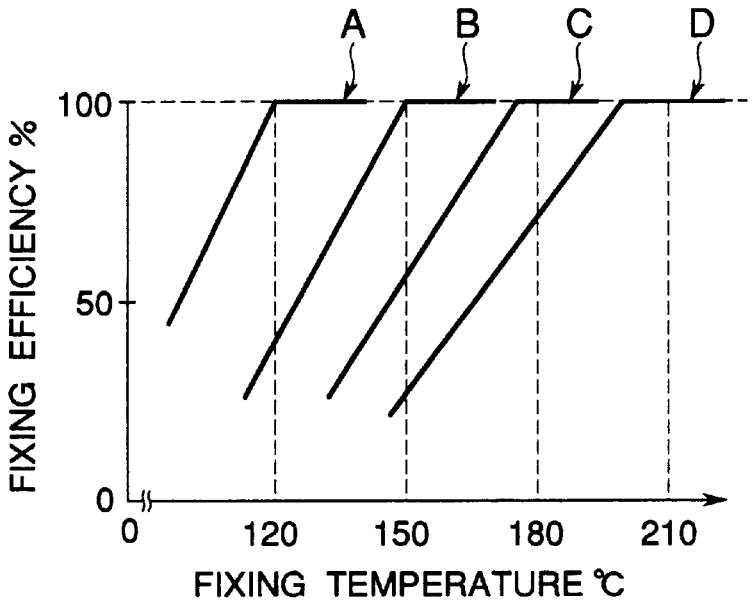
FIG. 3A illustrates the relationship among the melting point of toner, the fixing temperature, and the fixing efficiency of the fixing unit.
FIG. 3B is a table that lists Curves A-D, the melting points of toner, and transport speed of the recording medium.

The relationship between the melting point of toner, fixing temperature, and fixing efficiency will be described with reference to FIGS. 3A–3B. FIG. 3A illustrates the relationship among the melting point of toner, the fixing temperature, and the fixing efficiency. FIG. 3B is a table that lists Curves A–D, the melting points of toner, and transport speed of the recording medium.

In FIG. 3A, Tm is melting point of toner in ° C. and V is a transport speed in mm/s at which the recording medium 27 travels.

Generally speaking, the melting point of toner and the transport speed determine the fixing temperature. Using toner with a low melting point and a fixing temperature sufficiently higher than the melting point of toner allows the toner to melt more easily and the circumferential speed of the heat roller 36 (i.e., transport speed of the recording medium) to be increased.

In the present embodiment, the black toner used has a lower melting point than the other colored toners, the fixing temperature is set higher in the mono-color mode than in the multi-color mode, and the speed of travel of the recording medium 27 is set higher in the mono-color mode than in the multi-color mode. More specifically, the black toner has a melting point of 90° C. and the toner particles have an average diameter of 7 microns while yellow, magenta, and cyan toners have a melting point of 120° C. and toner particles have an average diameter of 9 microns. Different melting points of toner may be achieved by properly selecting the kind of resin that represents a large portion of each toner particle.

We assume that yellow, magenta, and cyan toners have a melting point of 120° C. and the recording medium 27 travels at a transport speed of 50 mm/s in the multi-color mode. In order to achieve a fixing efficiency of 100%, Curve A in FIG. 3A shows that a fixing temperature higher than 120° C. is enough for black toner since black toner has a melting point of 90° C. In order to achieve a fixing efficiency of 100% for the colored toners, Curve B in FIG. 3A shows that the fixing unit 35 needs to be set for a fixing temperature higher than 150° C. Thus, the fixing temperature is set to 150° C. in the multi-color mode.

Since the transport speed of travel of the recording medium 27 in the mono-color mode is set twice that in the multi-color mode, the recording medium 27 travels at 100 mm/s in the mono-color mode. Curve C in FIG. 3A shows that the fixing efficiency is 100% if the fixing temperature for black toner is set to 180° C. Thus, the controller 41 controls the fixing unit 35 to maintain the fixing temperature at 180° C. in the mono-color mode.

Transporting the recording medium 27 at a speed twice that in the mono-color mode allows the controller 41 to operate to its full capacity in the mono-color mode. In accordance with such a selection of transport speed, the melting point of black toner is 30° C. lower than that of the other colored toners, and the controller 41 sets the fixing temperature 30° C. higher in the mono-color mode than in the multi-color mode.

Setting the fixing temperature higher in the mono-color mode than in the multi-color mode allows the transport speed of the recording medium 27 to be higher in the mono-color mode than in the multi-color mode, even if the black toner has the same melting point as the other colored toners.

A variety of ratios of the transport speed in the mono-color mode to that in the multi-color mode can be selected as required. The transport speed of the recording medium 27 in the mono-color mode may be selected to be, for example, less than twice or more than twice that in the multi-color mode. The melting points of toners and the fixing temperatures of the fixing unit 35 may be selected accordingly.

Using black toner having a melting point lower than that of the other colored toners and a lower fixing temperature in the mono-color mode than in the multi-color mode is advantageous in that the same fixing unit 35 can used both in the mono-color mode and in the multi-color mode.

The color image recording apparatus 1 according to the present invention may be used as an output device not only for computers but also for copying machines and communication terminal equipment. While the present invention has been described with respect to an LED head, the invention may be applicable to cases where a laser printhead or a liquid crystal shutter is used in place of the LED head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A color image forming apparatus having an image forming section wherein an image is formed on a rotating photoconductive body in accordance with print data to print the image on a recording medium selectively in a multi-color mode and in a mono-color mode, the apparatus comprising:

a data-identifying section, identifying the print data as to whether the print data is for color printing or for mono-color printing; and a mode-selecting section, selecting a multi-color mode if the print data is for color printing and a mono-color mode if the print data is for mono-color printing wherein the photoconductive body rotates at a greater speed when one page of image is printed in the mono-color mode than when one page of image of a corresponding color is printed in the multi-color mode;

a recording medium is transported at the greater speed when one page of image is printed in the mono-color mode than when one page of image of a corresponding color is printed in the multi-color mode; and a fixing operation is performed at the greater speed in the mono-color mode than in the multi-color mode.

2. The color image forming apparatus according to claim 1, wherein said mode-selecting section sets a fixing unit for a higher fixing temperature in the mono-color mode than in the multi-color mode.

3. The color image forming apparatus according to claim 2, wherein a first type of toner is used in the mono-color mode and a second type of toner is used in the multi-color mode, the first type of toner having a lower melting point than the second type of toner.

4. The color image forming apparatus according to claim 3, wherein the first type of toner is black toner.

5. The color image forming apparatus according to claim 1, wherein the image forming section is one of a plurality of image forming sections aligned substantially in a direction of travel of a recording medium so that toner images of different colors are printed in superposition on the recording medium as the recording medium passes through the plurality of image forming sections.

6. The color image forming apparatus according to claim 5, wherein said mode-selecting section sets a fixing unit for a higher fixing temperature in the mono-color mode than in the multi-color mode.

7. The color image forming apparatus according to claim 6, wherein a first type of toner is used in the mono-color mode and a second type of toner is used in the multi-color mode, the first type of toner having a lower melting point than the second type of toner.

8. The color image forming apparatus according to claim 7, wherein the first type of toner is black toner.

* * * * *

US006148163C1

(12) EX PARTE REEXAMINATION CERTIFICATE (4966th)

United States Patent

Ito

(10) Number: US 6,148,163 C1

(45) Certificate Issued: Jul. 20, 2004

(54) CONTROL SPEED AND FUSER TEMPERATURE BASED UPON MONOCHROMATIC OR FULL-COLOR PRINTING

(75) Inventor: Katsuyuki Ito, Tokyo (JP)

(73) Assignee: Oki Data Corporation, Tokyo (JP)

Reexamination Request:
No. 90/006,389, Sep. 23, 2002

Reexamination Certificate for:

| | |
|---|---|
| Patent No.: | **6,148,163** |
| Issued: | **Nov. 14, 2000** |
| Appl. No.: | **09/241,131** |
| Filed: | **Feb. 1, 1999** |

(30) Foreign Application Priority Data

Feb. 10, 1998 (JP) ..... 10-028734

(51) Int. Cl.[7] ..... G03G 15/20

(52) U.S. Cl. ..... 399/67; 399/69; 399/82; 399/299; 399/303; 399/396

(58) Field of Search ..... 399/8, 82, 85, 399/320–341, 68

(56) References Cited

U.S. PATENT DOCUMENTS

| | | | | |
|---|---|---|---|---|
| 4,549,803 A | | 10/1985 | Ohno et al. | |
| 5,001,519 A | | 3/1991 | Saito | |
| 5,408,301 A | | 4/1995 | Tokishige et al. | |
| 5,517,293 A | | 5/1996 | Tonai et al. | |
| 5,587,783 A | | 12/1996 | Nakamura et al. | |
| 5,659,864 A | | 8/1997 | Oka et al. | |
| 5,724,628 A | | 3/1998 | Sano | |
| 5,749,036 A | * | 5/1998 | Yoda et al. | 399/325 |

FOREIGN PATENT DOCUMENTS

| | | |
|---|---|---|
| JP | 05-330130 | 12/1993 |
| JP | 06-258914 | 9/1994 |
| JP | 07-219385 | 8/1995 |

* cited by examiner

*Primary Examiner*—S. Chen

(57) ABSTRACT

A color image forming apparatus is capable of color printing and monochrome printing in accordance with print data. The apparatus has a plurality of image-forming sections that print toner images of corresponding different colors. The plurality of image-forming sections are aligned in a direction of travel of a recording medium, and print the respective toner images on the recording medium in superposition. The toner images are subsequently fixed at a fixing unit. The apparatus includes a data-identifying section and a mode-selecting section. The data-identifying section identifies the print data as to whether the print data is for color printing or for monochrome printing. The mode-selecting section selects a multi-color mode if the print data is for color printing and a mono-color mode if the print data is for mono-color printing. A printing operation is performed at a higher speed in the mono-color mode than in the multi-color mode. The mode-selecting section sets the fixing unit for a higher fixing temperature in the mono-color mode than in the multi-color mode.

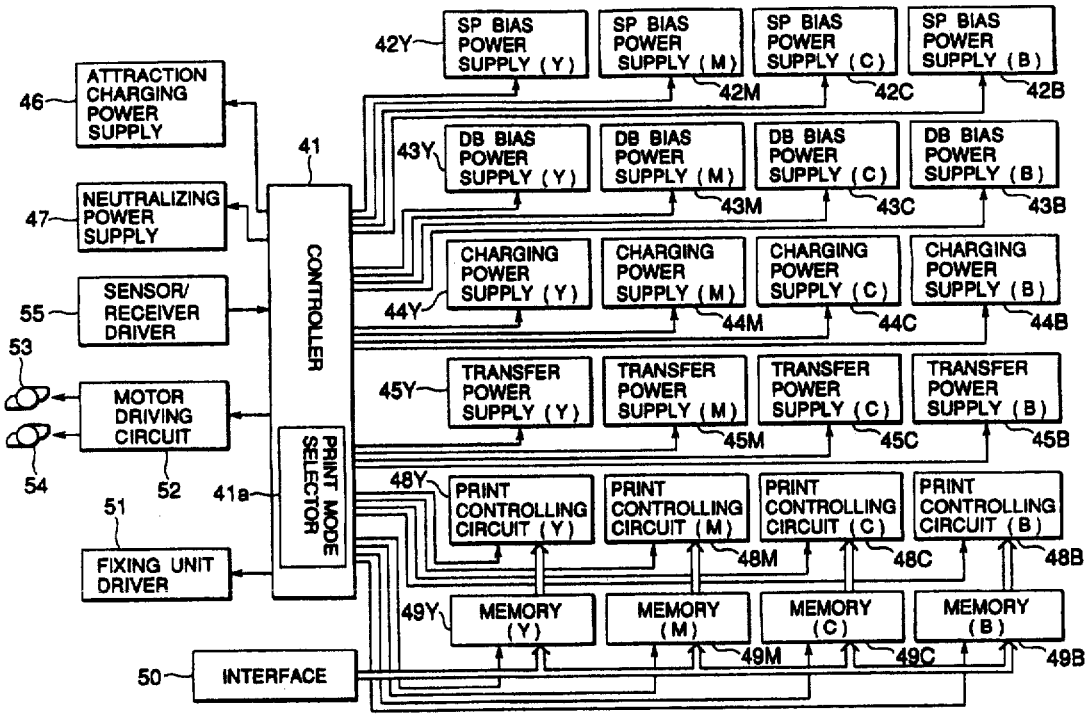

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–8, dependent on an amended claim, are determined to be patentable.

New claims 9–12 are added and determined to be patentable.

1. A color image forming apparatus having an image forming section wherein an image is formed on a rotating photoconductive body in accordance with print data *received from an external apparatus* to print the image on a recording medium selectively in a multi-color mode and in a mono-color mode, the apparatus comprising:

a data-identifying section, identifying the print data as to whether the print data is for color printing or for mono-color printing *in response to receiving the print data*; and a mode-selecting section, selecting a multi-color mode if the print data is for color printing and a mono-color mode if the print data is for mono-color printing wherein the photoconductive body rotates at a greater speed when one page of *the* image is printed in the mono-color mode than when one page of *the* image of a corresponding color is printed in the multi-color mode;

a recording medium is transported at the greater speed when one page of *the* image is printed in the mono-color mode than when one page of *the* image of a corresponding color is printed in the multi-color mode; and a fixing operation is performed at the greater speed in the mono-color mode than in the multi-color mode.

*9. The color image forming apparatus according to claim 5, wherein said mono-color mode performs a monochrome printing operation using a black toner.*

*10. The color image forming apparatus according to claim 1, wherein the image forming section is one of a plurality of image forming sections each of which has a corresponding photoconductive body, wherein the photoconductive body rotates at a higher speed in the mono-color mode than in the multi-color mode.*

*11. The color image forming apparatus according to claim 10, wherein said mono-color mode performs a monochrome printing operation using a black toner.*

*12. The color image forming apparatus according to claim 1, wherein said mono-color mode performs a monochrome printing operation using a black toner.*

* * * * *